US005984797A

United States Patent [19]

Kessler et al.

[11] Patent Number: 5,984,797

[45] Date of Patent: Nov. 16, 1999

[54] GOLF SWING TRAINING SYSTEM

[75] Inventors: David W. Kessler; Richard Wyzinski; Stephanie P. Kossnar, all of Elk Grove Village, Ill.

[73] Assignee: John W. Deabler, Inc., Waukesha, Wis.

[21] Appl. No.: 09/237,572

[22] Filed: Jan. 26, 1999

[51] Int. Cl.[6] ..... A63B 69/36

[52] U.S. Cl. ..... 473/216; 473/277

[58] Field of Search ..... 473/215, 216, 473/277

[56] References Cited

U.S. PATENT DOCUMENTS 2,626,151 1/1953 Jenks ..... 473/216 X 5,050,885 9/1991 Ballard et al. ..... 473/216

*Primary Examiner*—George J. Marlo

*Attorney, Agent, or Firm*—Dillis V. Allen, Esq.

[57] ABSTRACT

A golf swing training system with a floor mounted base and a pelvic belt that wraps around the golfer's hips and guides but not unduly restricts the golfer's pivot during the back swing and follow through. The system encourages a pelvic pivot about an axis to the rear of the golfer's right leg in the back swing and down swing, and a pivot about an axis behind the golfer's left leg in the follow through. A multiple pivot mechanism that connects the belt to the base inhibits lateral movement of the hips during the back swing and down swing. The belt is connected to the base by an expandable link pivotally connected at one end to the base and pivotally connected at its other end to the belt, both about generally vertical axes. As the golfer initiates the back swing, the belt pivots about the second axis as the link pivots in the opposite direction about the first axis. The link, as it rotates, expands somewhat and a pivotal column on the base pivots about a horizontal axis parallel to the target line in a vertical plane transverse to the target line. As the golfer initiates the down swing, the link collapses and moves to a position almost parallel to the target line but somewhat outward from the address position. In the ball impact position, the link is collapsed between the belt and the base substantially parallel to the target line.

19 Claims, 10 Drawing Sheets

GOLF SWING TRAINING SYSTEM

BACKGROUND OF THE INVENTION

As golfers have searched vainly for the perfect golf swing over the last 150 years in the history of this game, teachers and engineers have sought and designed teaching aids that hopefully will improve the golfer's swing to hit the ball more consistently and further.

One such tool is a golf swing training system shown in the Ballard, et al., U.S. Pat. No. 5,050,885. The Ballard system includes a shoulder guiding device 122, 130, and 135 and a hip saddle 112 that straps around the pupil's hip area. The thrust of the Ballard system is the provision of a lateral slide 90 on the base that permits the belt and the golfer's hips to slide from two to six inches during the back swing, the down swing, and follow through. The slide 90 has a pair of rollers 87 and 88 that ride on a linear rail 61 that is parallel to the target line. Pivotal movement of the saddle is accommodated by a shaft 57 that permits the saddle to pivot about a horizontal axis perpendicular to the target line to accommodate the player's tendency to raise one hip relative to the other. The sliding carriage is pivotally mounted on the base about a horizontal axis shown in FIG. 5, parallel to the target line and biased by a spring 51 that appears to accommodate the downward movement of the hips during the golf swing.

The slide 90 carries a first pivot 94, as seen in FIG. 9, upon which a link 99 is pivotal having another pivot 93 at its distal end to which the hip saddle 91 is connected. At the address position illustrated in FIG. 15, the slide 90 is positioned centrally on the rail 61 by springs 84 and 85, hip saddle 91 faces the ball, and the pivoting link 99 is parallel to the target line. During the back swing as depicted in FIG. 16, the slide 90 slides linearly away from the target compressing spring 84, and the belt pivots 45 degrees about the pivot 94, causing the user's spine to shift backwardly a substantial distance rearwardly from the ball.

During the down swing, the belt pivot 93 and the slide 90 slide toward the target back to substantially the address position described above. Thereafter, during the follow through, the link 99 rotates counter-clockwise from its address position and actually throws the golfer toward the golf ball a substantial distance during the follow through. At the same time, the slide 90 compresses spring 85, causing a substantial lateral shift of the hips during the follow through compressing spring 85, as depicted in FIG. 17.

The lateral shifting of the saddle in the Ballard system during both the back swing and the down swing is not believed by most teaching professionals to be an appropriate teaching methodology.

The Remington, U.S. Pat. No. 1,530,519, shows a golf training apparatus designed to prevent any vertical or upward motion during golf swing. The golfer is restricted to pivoting his body around the fixed axis.

The Hara, U.S. Pat. No. 2,611,610, shows a mechanical system that holds the shoulders, hips and feet in position during the swing.

Another Hara, U.S. Pat. No. 2,755,091, shows a teaching device that restricts the golfer's hip movement to rotary motion about a single axis, as does the device shown in the Abel, U.S. Pat. No. 3,429,571.

The Sheldon, U.S. Pat. No. 3,215,438, shows a hip training device for golfers that gives a warning signal when hip rotation departs from a single axis.

The Anselmo, et al., U.S. Pat. No. 4,593,909, has similar deficiencies to the Sheldon system.

The Jenks, U.S. Pat. Nos. 2,626,151, and 2,737,432, show golf training systems which coordinate body movement with some lateral movement of the hips.

The following patents also show swing training devices:

| Inventor | U.S. Pat. No. | Issue Date |
|---|---|---|
| Strong | 4,691,924 | 9-8-87 |
| Bambrick | 1,854,392 | 4-19-32 |
| Boldt | 3,415,523 | 2-10-68 |
| Oppenheimer | 3,876,212 | 4-8-75 |
| Morris | 3,895,366 | 7-15-75 |
| Oppenheimer | 3,917,281 | 11-4-75 |
| Oppenheimer | 4,034,991 | 7-12-77 |
| Beckish | 4,071,251 | 1-31-78 |
| Oppenheimer | 4,211,418 | 7-8-80 |
| Kiehl | 4,326,718 | 4-27-82 |
| Vuick | 4,659,084 | 4-21-87 |

It is a primary object of the present invention to ameliorate the problems noted in the above prior art and to provide a swing training system that is not overly restrictive and one which discourages excessive hip sway.

SUMMARY OF THE PRESENT INVENTION

In accordance with the present invention, a golf swing training system is provided that guides the golfer's hip rotation during the back swing and down swing and the follow through which, with repetition, enables the golfer's muscle memory to repeat the desired hip rotation on the golf course without the training system. This hip rotation concept involves the pivotal motion of the hips during the back swing and down swing about a generally vertical axis to the rear and inside of the right hip socket(for right-handed golfers). During the follow through, the pivotal axis for the hips switches to a generally vertical axis outside and to the rear of the left hip socket. This dual axis hip pivot automatically teaches the golfer the proper weight transfer from the right side to the left side.

Two of the principal advantages of the present training system is that it eliminates undesirable hip sway and pivoting around a single axis that is taught in several prior swing training systems, such as the ones described in the Background of the Invention. Hip sway is the lateral or sliding movement of the hips in a plane parallel to the target line—and this motion is difficult for the golfer to control because the rear sway during the back swing requires a perfectly timed forward sway in the down swing to position the club properly at impact.

A further feature of the present system is that it encourages without demanding the forward step of the rear leg over the forward leg after the follow through. This step teaches the golfer the proper total weight transfer to the left and is a valuable training tool. In fact, top professional golfers, such as present senior player, Gary Player, actually use this step while on the golf course.

Toward these ends, the present golf swing training system includes a floor mounted base and a pelvic belt that wraps around the golfer's hips and guides but not unduly restricts the golfer's pivot during the back swing and follow through. The multiple pivot mechanism that connects the belt to the base inhibits lateral movement of the hips during the back swing and down swing. The belt is connected to the base by an expandable link pivotally connected at one end to the base and pivotally connected at its other end to the belt, both about generally vertical axes. As the golfer initiates the back swing, the belt pivots about the second axis as the link pivots in the opposite direction about the first axis. The link, as it rotates, expands somewhat as the spine travels in a clockwise arc about the pivot axis to the rear and inside of the right hip socket. As the golfer initiates the down swing, the link collapses and moves to a position almost parallel to the target line but somewhat outward from the address position. In the ball impact position, the link is collapsed between the belt and the base substantially parallel to the target line. The extension of the link during the back swing is what encourages the left hip to move clockwise and the spine to travel on the appropriate arc.

During the follow through, the link swings counter-clockwise allowing the right hip to move counter-clockwise and the spine to trace the appropriate arc which is an arc generally about the axis outside and to the rear of the left hip socket. After the follow through with the link collapsed and generally parallel to the target line, the golfer is encouraged to step forward toward the target by the expandable link which permits extension of the belt toward the target as the golfer takes an extra step with the rear leg over the forward leg toward the target encouraging an exceptional follow through.

Each of the first and second pivotal axes of the link are provided with an address biasing system. These address biasing systems are coil compression spring assemblies with an adjustable preload that permits the instructor to vary swing resistance based upon the strength, size and ability of the pupil. The coil spring assemblies are coaxial with each of the pivots for compactness and ease of adjustment. The swing resistance created by these biasing systems urges the hip belt and the pivoting link back toward the address position in the back swing, down swing, and the follow through. This swing resistance not only builds muscle but with repetition enhances muscle memory more than a passive training system with no swing resistance.

Another objective of the present swing trainer is to achieve a compact swing of the type institutionalized by the swing of Gene Sarazen. That swing is characterized by a full hip turn in the back swing but not more than 45 degrees, a substantial weight shift to the right foot in the back swing without a significant lateral shifting of the hips, a down swing initiated by the lower legs with the hips moving back toward the address position, an impact position with the lower body not leading the upper body significantly in contra-distinction to the Johnny Miller reverse "C" position at impact, with the body generally upright and the shoulders remaining generally horizontal and a compact follow through with the hips facing the target and the hands flowing up and over the head again with the shoulders mainly horizontal.

The present system achieves these results in part by providing a rigid lateral connection between the first pivot and the base to prevent free sliding lateral movement of the belt. Next, the dual pivot permits the free rotational movement of the belt during the back swing and the expandable link permits the golfer's spine to move on the desired arc. Each of these freedom of movement features are not without limits and while the golfer is permitted some freedom of movement, he or she is still restricted by the mechanical limits of the system; otherwise, the training device would have no purpose.

One of the inventors, Stephanie Kossnar, has been playing golf and receiving golf instruction for over 37 years. She has been involved in training, development of training products, and technical writing for 30 years. Working as a golf instructor for the last 4 years, she has found that the two generally held theories of the golf swing do not explain the actual(or correct) movement of the body during the swing. The first of these concepts is rotating around a central axis during the swing, and the second is where the hips make a lateral movement preceding the rotation for the backswing and the rotation for the downswing.

Because the lower body is the foundation of the swing, and the lower body has two support points(the left leg and the right leg), Stephanie's concept of the swing purports that there are two points of rotation, or axes, in the swing. One of these points is for the backswing motion and the second for the follow-through. In each rotation, the spine moves on an arc originating about the two axes described above.

During the backswing, the mechanism allows the golfer's weight to be transferred to the inside of the right leg as the spine moves on an arc around the first axis point. The rigid belt holds the golfer's hips in a level position. This discourages a reverse pivot(the weight shifting onto the left leg instead of the right). Because the movement of the spine on the arc of the first axis discourages both a lateral movement and a rotation of the hips around a center axis, this movement "pulls" the weight off the left side and onto the right. This also prohibits a reverse pivot.

The opening of the expandable link allows the left hip to continue on the arc of the first axis to allow the hips to rotate to 40–45 degrees depending upon the flexibility of the golfer. The location of the first axis restricts the right hip from rotating beyond the perpendicular line of the two axes at the address position. This restriction prevents sway of the lower body. (Sway is defined as an excessive weight shift to the outside of the right leg and foot in a right-handed golfer's backswing. This prevents the proper shift back to the left during the downswing). Previous center-axis or lateral-hip-movement training devices allow or encourage sway.

During the downswing, the golfer's spine returns to approximately the original stance position. The weight then shifts to the forward or left side, and the second axis defines a new arc formed by the radius between the second axis and the spine. The spine travels along this new arc toward the target until the golfer's body is facing the target on a line perpendicular to the target line.

At this point the golfer's momentum is allowed to continue traveling off the arc toward the target, and he may take a step over to maintain balance.

The golf training apparatus of the present invention virtually demands that the golfer accurately execute these series of steps that make up Stephanie's concept of the golf swing.

BRIEF DESCRIPTION OF THE DRAWINGS

FIGS. 13 to 19 are schematic top views of the present golf swing training system showing the position of the base column and the belt assembly and linkage in sequence during the back swing, down swing, and follow through.

DETAILED DESCRIPTION OF THE PREFERRED EMBODIMENT

Figure 1:
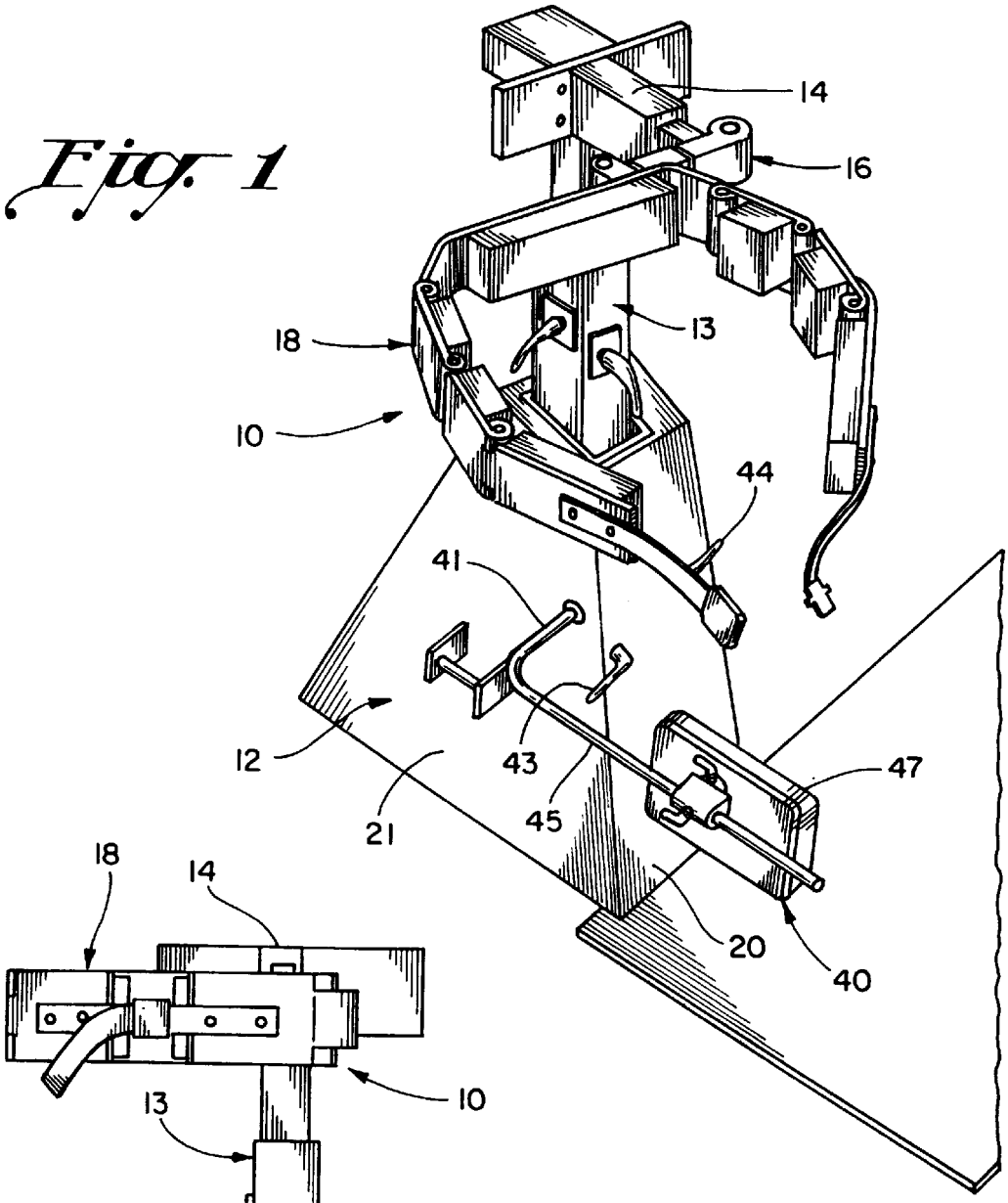
FIG. 1 is a perspective view of the present golf swing training system.
Figure 2:
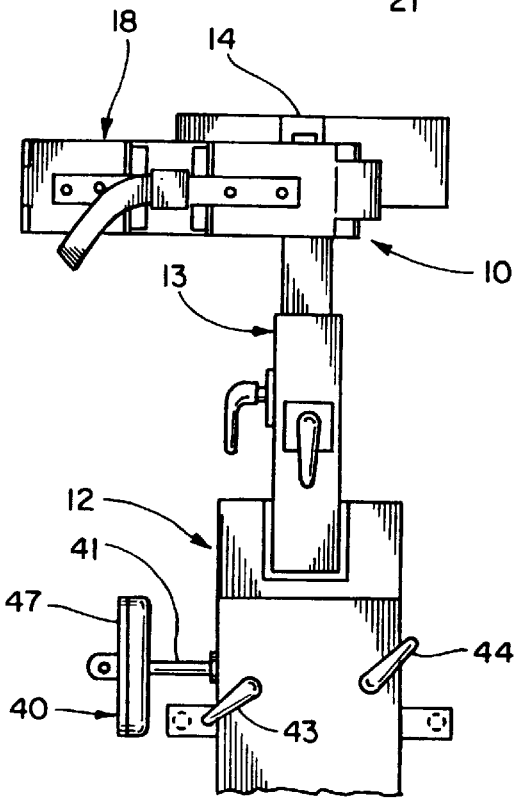
FIG. 2 is a front view partly fragmented view of the present golf swing training system illustrated in FIG. 1.
Figure 3:
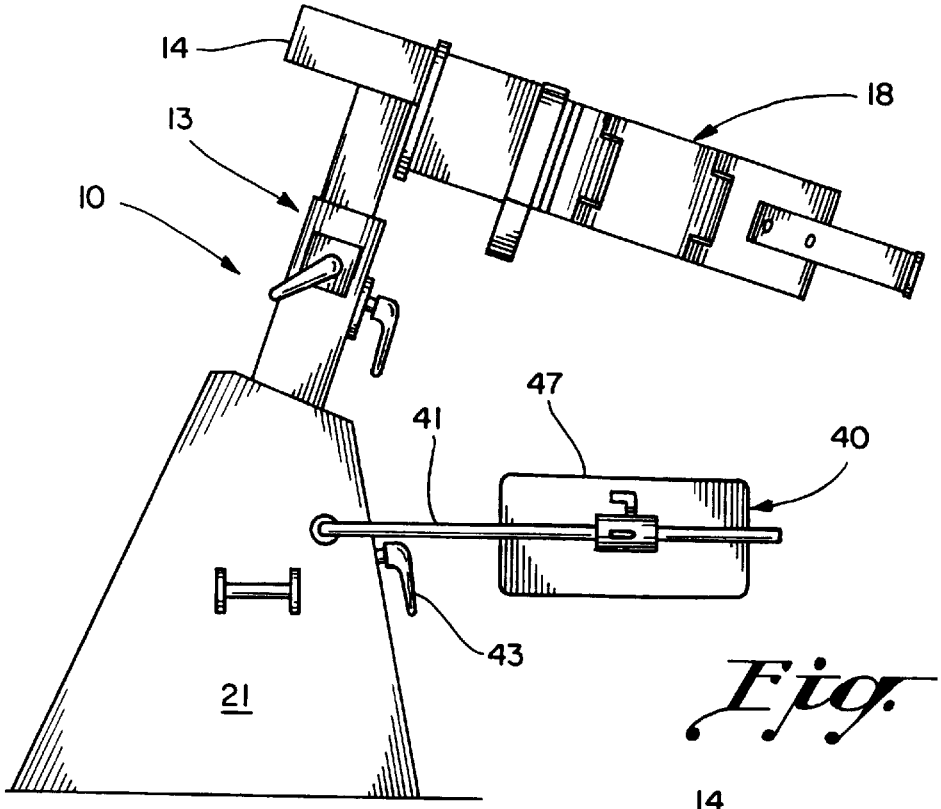
FIG. 3 is a left side view of the golf swing training system shown in FIGS. 1 and 2.

Referring to the drawings and particularly FIGS. 1 to 8, a golf swing training system 10 is illustrated consisting generally of a base 12, a vertically extendible column assembly 13 pivotally mounted in the base 12, a column head 14 fixed to the top of the column assembly 13, an expandable pivotal link assembly 16 carried by the head 14, and pivotally supporting a hip belt assembly 18, which is adapted to be strapped about the golf pupil's hips. The base 12 has a truncated pyramidal shape including front wall 20, side walls 21 and 22, a rear wall 24, a bottom wall 25, and a top wall 26 through which pivotal column assembly 13 projects.

Figure 7:
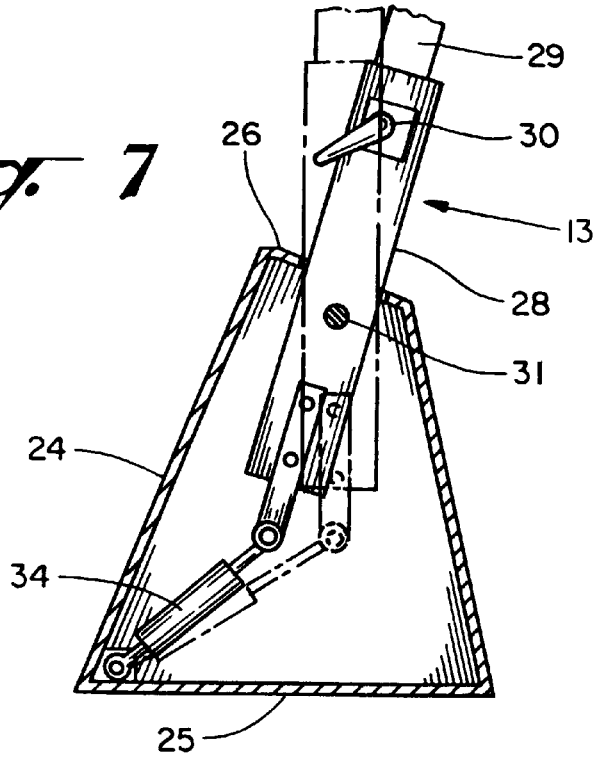
FIG. 7 is a partly fragmented left side view of the base of the golf swing training system illustrated in FIGS. 1 to 6.
Figure 8:
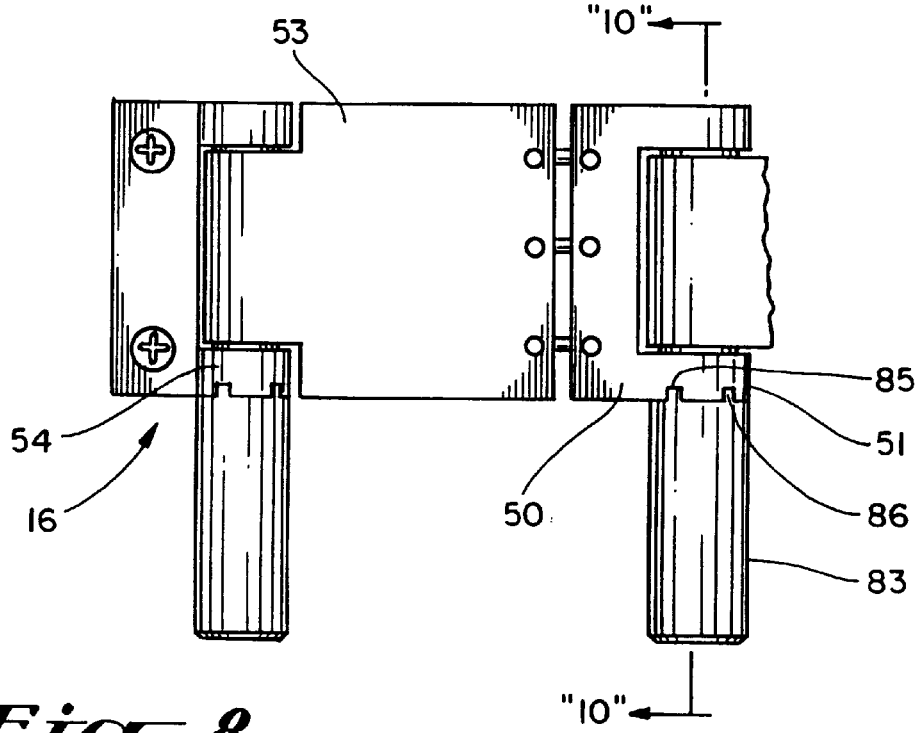
FIG. 8 is an enlarged fragmentary section of the expandable link taken generally along line 8—8 of FIG. 6.

As seen in FIG. 7, the column assembly 13 includes a lower channel member 28, generally rectangular in cross section that slidably receives an inner channel member 29 that is vertically adjustable in the lower channel member a n d locked in position by a handle-operated stop 30. In this way, the belt assembly 18 can be adjusted to the appropriate hip height of the golfer. The lower column channel 28 is pivotally mounted on rod 31, shown more clearly in FIG. 5. The lower column channel 28 is biased to its vertical position by a pair of hydraulic biasing element cylinders 33 and 34 fixed to the lower portions of the side walls 21 and 22 at one end, and to brackets 36 carried by the lower end of column channel 28. The pivoting of column assembly 13 about rod 31 enables the belt to move in a plane transverse to target line toward and away from the ball as the golfer swings.

Figure 5:
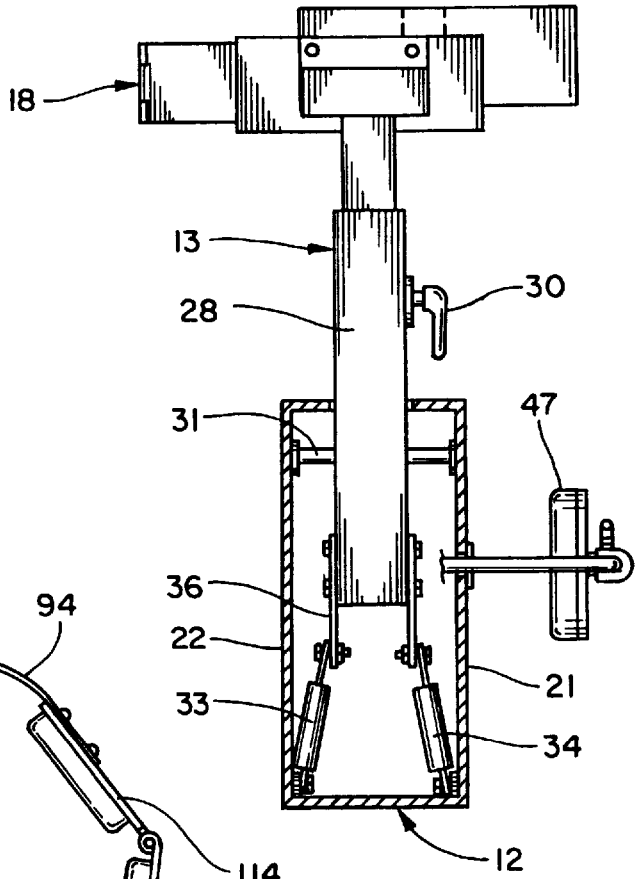
FIG. 5 is a partly fragmented rear view of the golf swing training system as shown in FIGS. 1 to 4.
Figure 12:
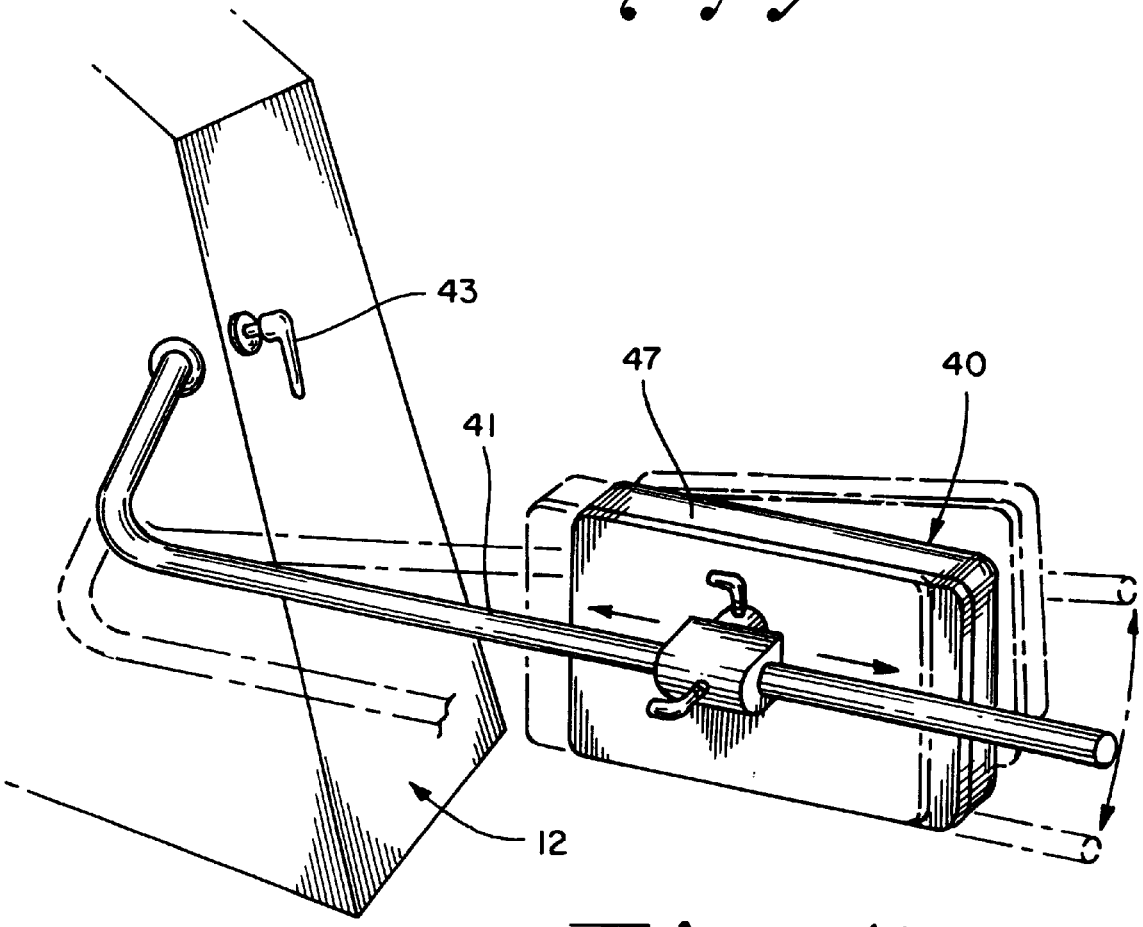
FIG. 12 is a fragmented perspective view of the leg stop according to the present invention.

The base 12 also carries an adjustable leg stop assembly 40 that includes an L-shaped rod having a first leg portion 41 slidably received in the base, as seen in FIG. 5, and locked in position therein by handle operated locking members 43 and 44, and a second leg portion 45 that slidably receives a generally rectangular cushioned leg stop 47. Suitable means are provided for locking the leg stop 47 to the rod leg portion 45, and as seen in FIG. 12, the rod is rotationally adjustable in the base 12 to vary the vertical height of the leg stop 47. The leg stop 47 is designed to limit the rearward movement(a direction away from the target) by engaging the golfer's lower right leg(for right-handed golfers). This reduces undesirable right leg sway during the back swing.

Figure 6:
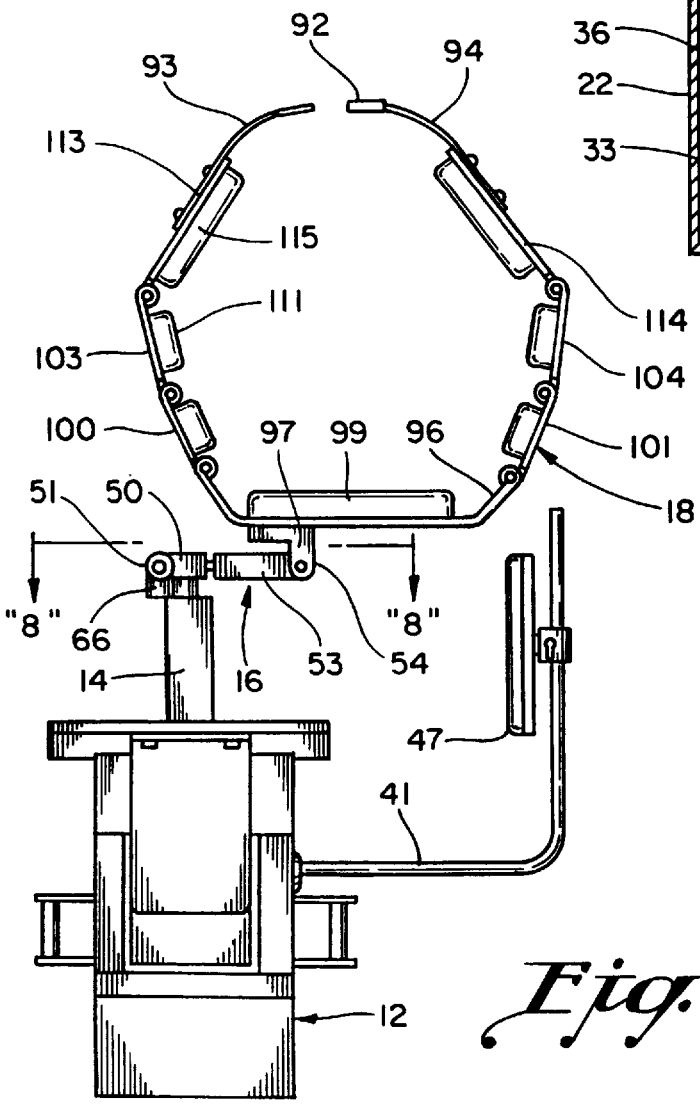
FIG. 6 is a top view of the golf swing training system illustrated in FIGS. 1 to 5.
Figure 9:
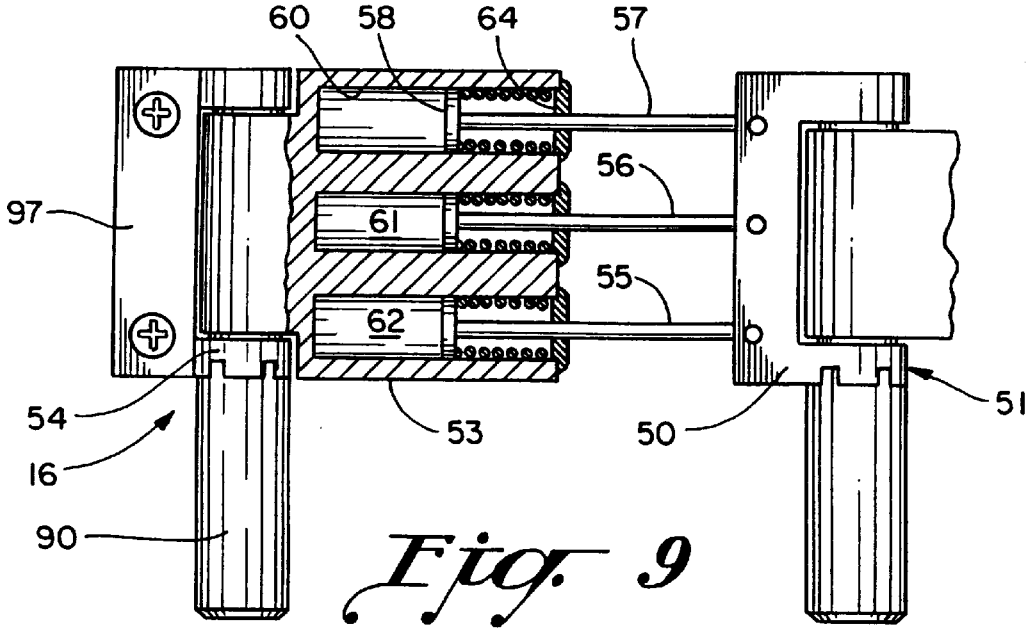
FIG. 9 is a partly fragmented view of the expandable link.

As seen in the top view of FIG. 6, the link assembly 16 includes a head portion 50 pivotally connected to the head 14 by a pivot assembly 51, and an extendible belt portion 53 pivotally connected to the belt by a second pivot assembly 54. The pivot 54 is about three to four inches to the left of the center of the belt assembly back plate 96 as viewed from the top in FIG. 6, for example. Link belt portion 53 extends during the golf swing at appropriate times to achieve the desired spine path. The link assembly 16 is shown in an almost collapsed position in FIG. 8 and an almost fully extended position in FIG. 9. As seen in FIG. 9, the link head portion 50 has three round rods 55, 56 and 57 fixed therein and each has a piston portion 58 slidable in one of the bores 60, 61 and 62, The pistons 58 are biased toward their retracted position by coil compression springs 64. The continuous biasing of the extendible link assembly 16 to its collapsed position offers resistance to extension by the golfer and improves proper muscle development.

Figure 10:
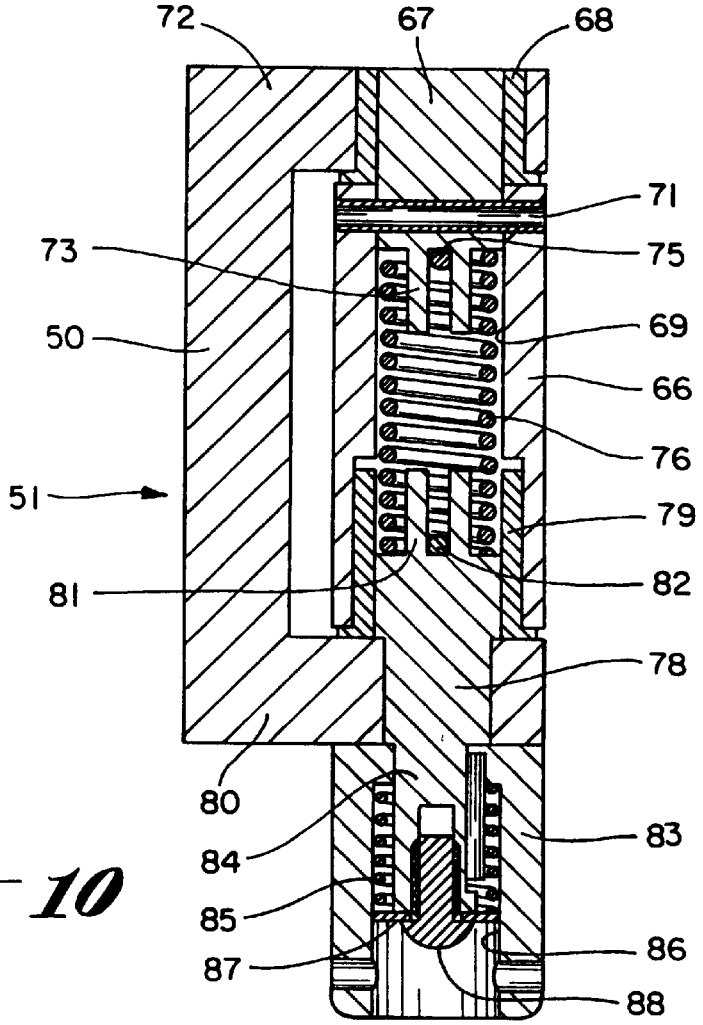
FIG. 10 is a longitudinal section of one of the pivot assemblies for the expandable link taken generally along line 10—10 of FIG. 8.

Both the pivot assemblies 51 and 54 have similar adjustable centering springs, one illustrated in FIG. 10, that respectively bias the link 16 to the address position in FIG. 6 parallel to the target line, and bias the belt assembly 18 to the address position. The pivot assembly 51 includes an annular boss 66 fixed to the column head 14. A pivot boss 67, carrying an annular bushing 68, is fixed in the top of the boss 66 by a roll pin 71. The link head portion 50 has an upper arm 72 rotatably mounted on bushing 68. The boss 67 has downwardly projecting spaced tangs 73 that receive upper spring arm 75 of a coil compression spring 76 mounted in bore 69. Tangs 73 hold the upper end of the spring 76 fixed. A stepped lower boss 78 is rotatable in a bushing 79 received in an enlarged lower portion of the bore 69 and it rotatably supports a lower arm 80, which is part of the link head portion 50. The boss 78 has a pair of upwardly projecting tangs 81 that receive a spring arm 82 on the lower end of the coil compression spring 76. An annular hand wheel 83 is keyed to the lower stepped portion 84 of the boss 78 but is slidable on the lower portion to disengage teeth 85 on the upper portion of annular hand wheel 83 that engage in complementary slots 86 in the lower arm 80 to lock the hand wheel 83 in the desired position with respect to the link head portion 50.

The hand wheel 83 is biased upwardly by a coil compression spring 85 in bore 86 that engages a spring seat 87 fixed to the lower end of the boss 78 by pin 88. By rotating the hand wheel 83, the tension of spring 76 can be adjusted as desired to vary the biasing force tending to rotate link head portion 50 to its address position shown in FIG. 6.

The pivot assembly 54 has a similar coil compression spring assembly adjusted by hand wheel 90 to vary the force tending to rotate the belt assembly 18 back to the address position shown in FIG. 6. By varying the biasing forces of the pivot assemblies 51 and 54, the resistance to the swinging motion of the belt assembly 18 can be varied as desired, bearing in mind as discussed above, that muscle memory is enhanced by greater resistance to the swing, which is also a muscle exercise function.

Figure 11:
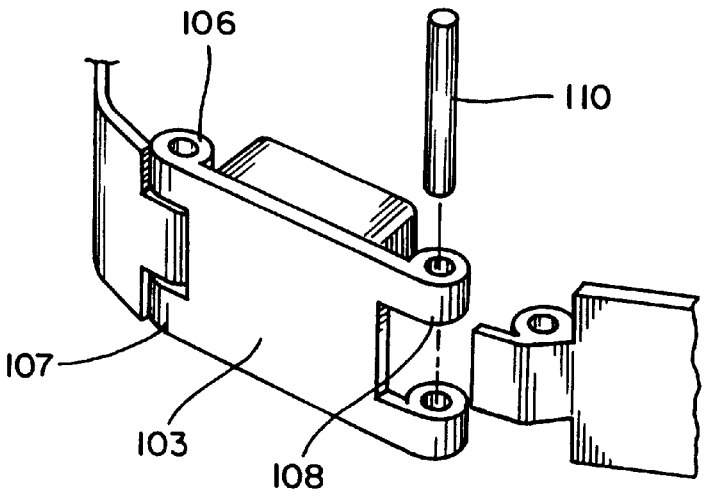
FIG. 11 is a fragmented perspective of several of the links in the hip belt assembly.

As seen in FIGS. 1 and 6, the belt assembly 18 includes a plurality of rigid aluminum links pivoted to one another that carry body engaging pads and a releasable clip assembly 92 carried by flexible belt portions 93 and 94. As seen in FIGS. 1 and 6, the belt assembly 18 includes a U-shaped rigid aluminum back plate 96 fixed to an L-shaped member 97 forming part of the pivot assembly 54 shown in FIG. 9. Back plate 96 carries an elongated pad 99 adapted to engage the golfer's back. Short links 100 and 101 are pivoted to the ends of plates 96 and similar short pivot links 103 and 104 are pivotally connected to links 100 and 101 respectively. The links 100 and 101 are identical and have spaced bosses at one end, and a central boss at the other end, while links 103 and 104 have spaced bosses 106 and 107 at one end and spaced bosses 108 at the other end and are pinned to one another by pivot pins 110, such as illustrated in FIGS. 10 and 11.

Each of the links 100, 101, 103 and 104, have rectangular body engaging pads 111. A pair of longer links 113 and 114 are pivotally connected to links 103 and 104 and have elongated body engaging pads 115 thereon, and these links carry the flexible belt portions 93 and 94 respectively.

Figure 13:
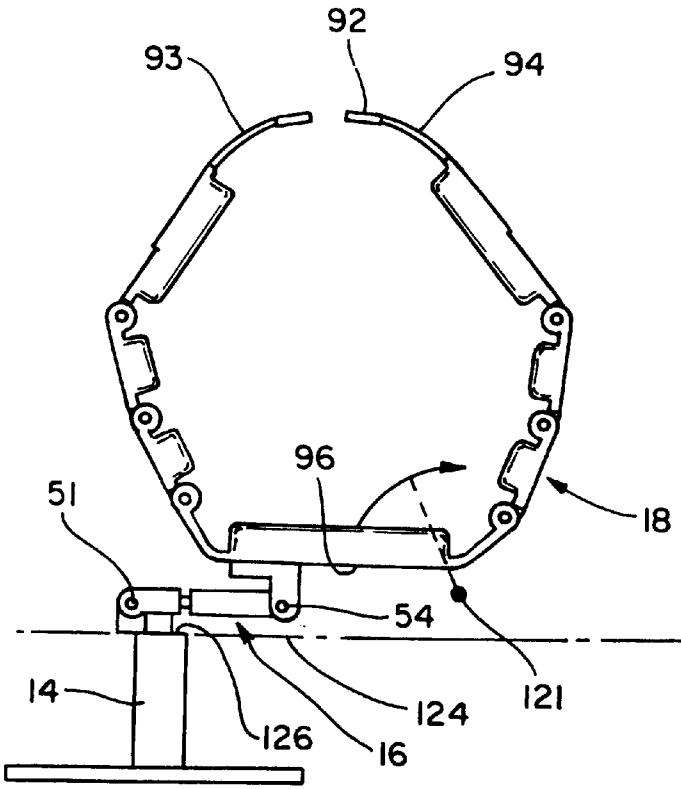
Figure 18:
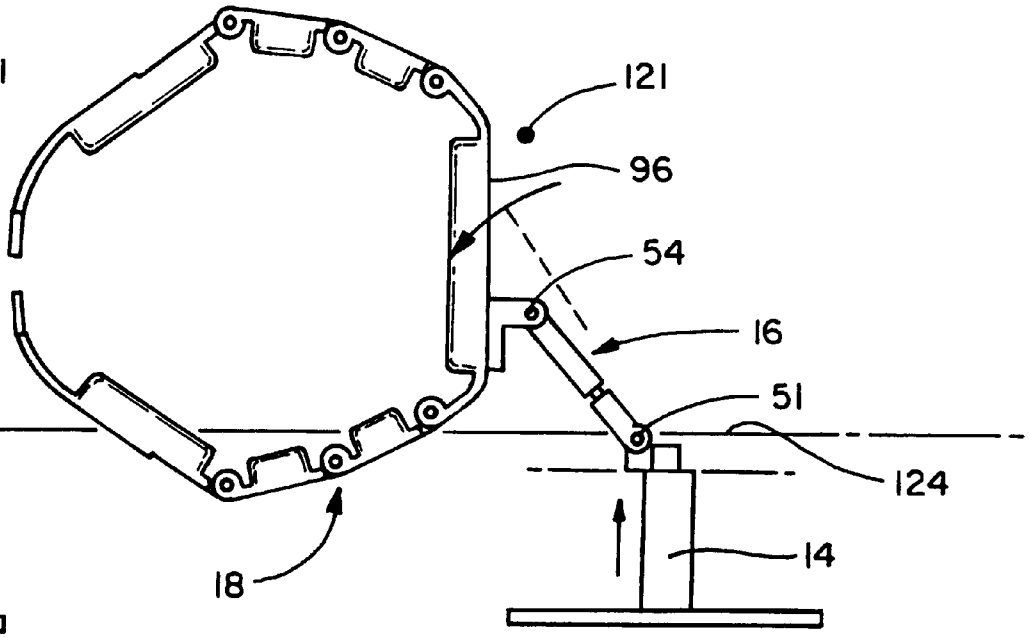
Figure 19:
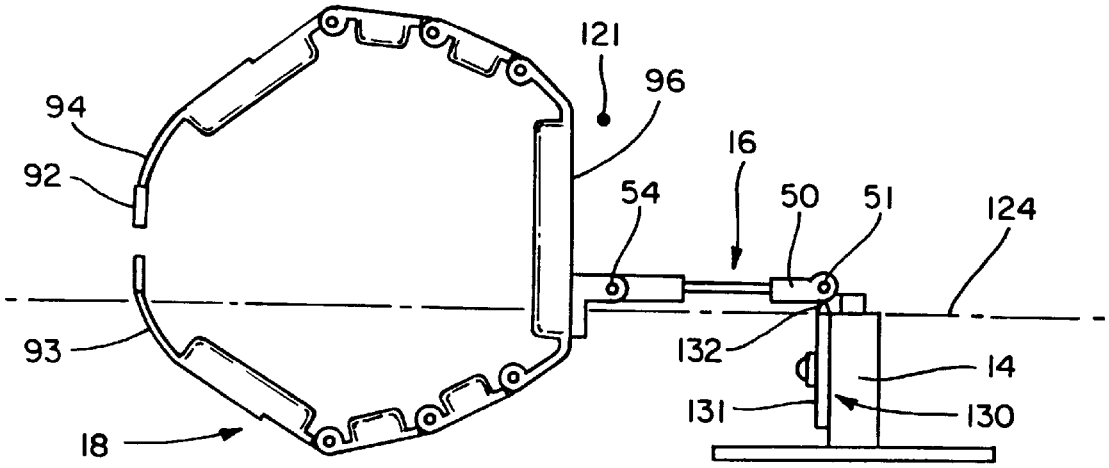

Reference will now be made to FIGS. 13 to 19, for a sequence of operation of the present golf swing training system beginning with the address position in FIG. 13 and ending with the right foot step over position illustrated in FIG. 19. Reference will also be made to certain other figures during this explanation. It should be understood that some of the details of the base and column, as well as the link assembly 16 and the belt assembly 18 have been eliminated for brevity and lack of confusion in these figures, but the details are believed shown clearly in FIGS. 1 to 12 above.

Also, the human form has not been illustrated in FIGS. 13 to 19 so the form does not obscure the mechanical parts of the system, but it should be understood that these positions are achieved with the belt assembly 18 around the golfer's hips and the clasp 92 adjusted and clamped.

The arrows depicted adjacent column head 14 in FIGS. 14, 15, 16, 17, 18, and 19 depict the movement of the column head and the column 13 about their pivot shaft 31. This movement, as noted above, is movement of the column assembly 13 in a plane perpendicular to the target line. Also, the reference numeral 124 in FIGS. 13 to 19 represents a fixed vertical plane parallel to the target line and coincident with forward surface 126 of the column head 14 in the address position illustrated in FIG. 13. Note, for example in FIG. 14, the forward surface 126 of the column head 14 is shifted away from the reference plane 124 representing a counter-clockwise rotation of the column about pivot shaft 31 as viewed in FIG. 3, for example.

Initially, the height of the belt assembly 18 is adjusted utilizing the locking device 30 in the column assembly 13. The top of the belt assembly 18 should be approximately level with the top of the golfer's pelvic bone, and the belt assembly 18 should be secure around the golfer by adjusting the straps 93 and 94. Note that when the golfer straps in belt assembly 18, the column assembly 13 is in its vertical position biased thereby the biasing devices 33 and 34. After this is completed, the golfer bends at the knees to the appropriate address position and addresses an actual golf ball, also in the appropriate position on the mat(not shown) adjacent the training system 10. This movement rotates the column assembly 13 toward the ball, causing it to assume approximately the position shown in FIGS. 3 and 4. And in this position note that the belt assembly 18 is on somewhat of an angle as are, of course, the golfer's hips in the proper address position.

Reference number 121 in FIGS. 13 to 19 indicates the first axis referred to above and pivot 51 is the second axis above and both define the centers for the correct arcs of the spine during the swing. As noted above, in the back swing and return to impact, the belt assembly 18 encourages the body to pivot about axis 121 and during follow through, to the FIG. 18 position completing follow through, the belt assembly 18 encourages the golfer to pivot generally about axis 51.

In the address position of FIG. 13, the link assembly 16 is completely collapsed, the link assembly 16 is parallel to the target line, the column head reference surface 126 lies in the reference plane 124 and the belt assembly back plate 96 is parallel to the target line.

Figure 14:
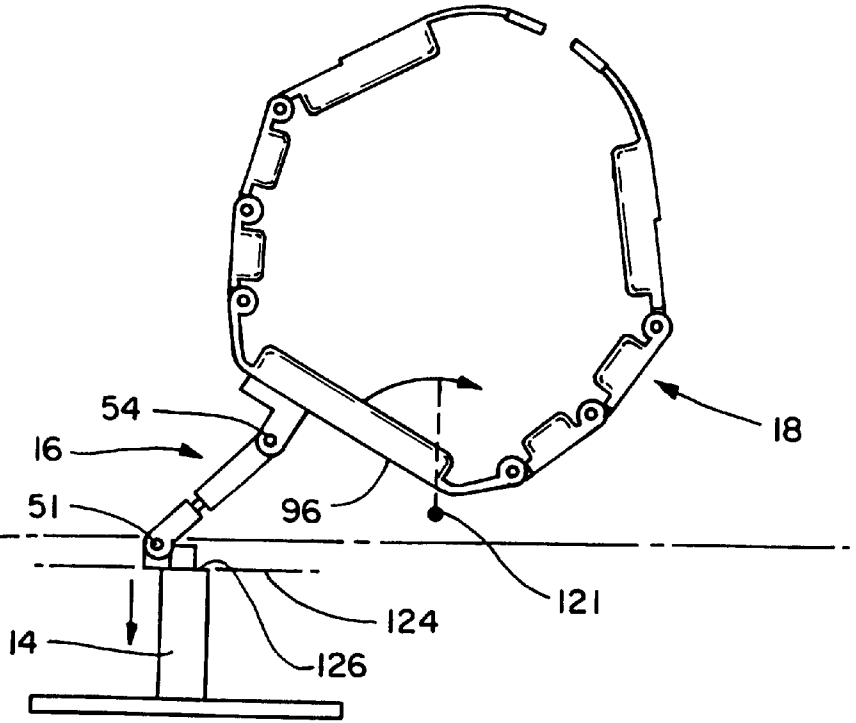

Midway through the back swing, as illustrated in FIG. 14, the link assembly swings counter-clockwise from its address position. In this position the link assembly 16 assumes a position of about 45 degrees counter-clockwise with respect to reference plane 124. At the same time the belt assembly rotates clockwise about pivot 54 about 80 degrees.

Figure 15:
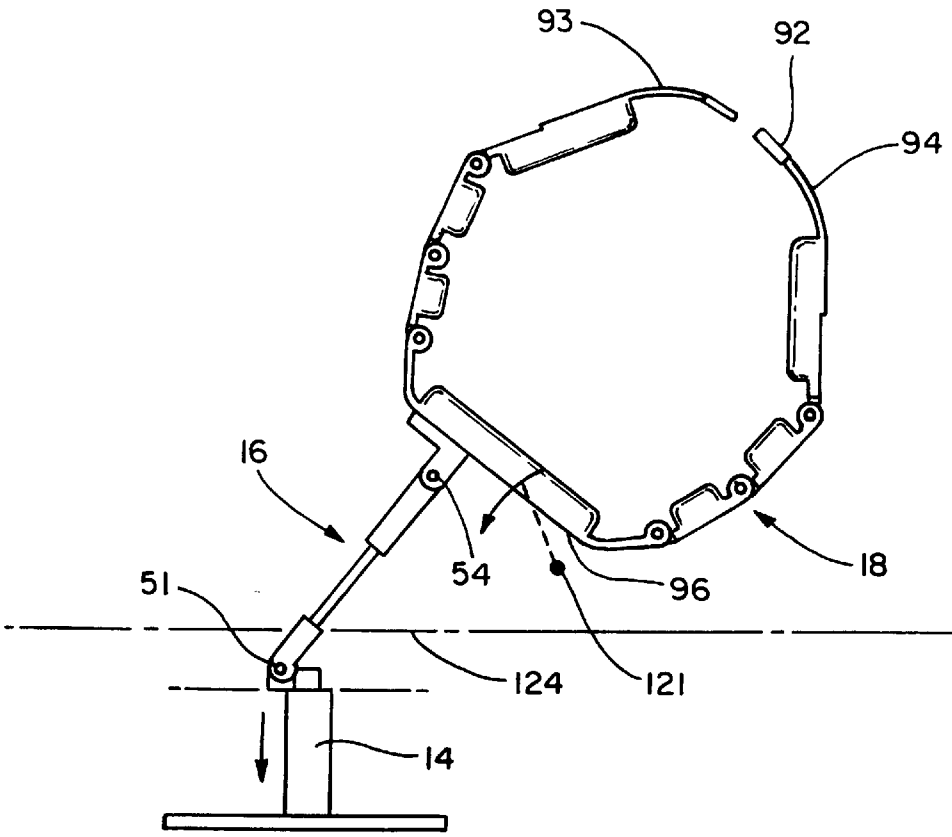

The completed back swing position is illustrated in FIG. 15, and here the link assembly 16 is fully extended and is rotated further counter-clockwise about pivot 51 about 15 degrees, and at the same time the belt assembly 18 is rotated clockwise about pivot 54 about 10 or 15 degrees further than the FIG. 14 position.

Figure 16:
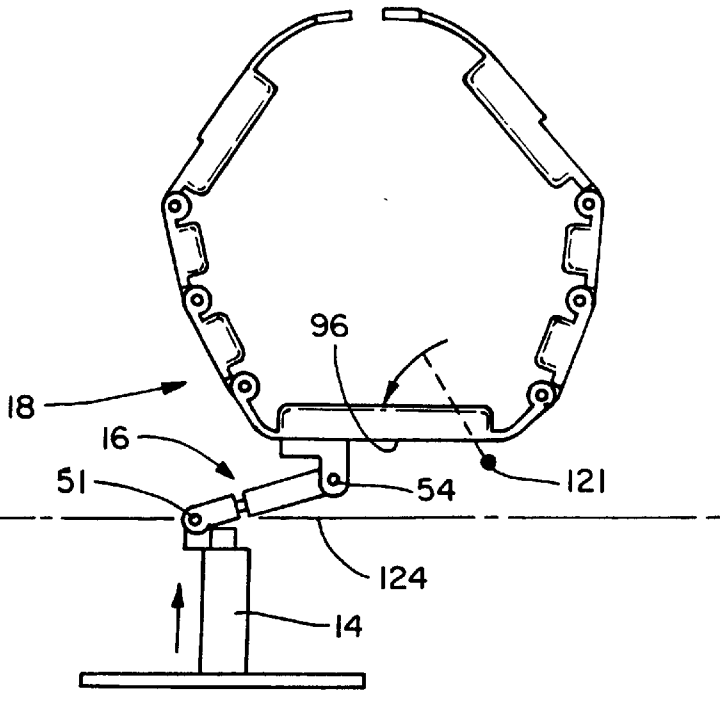

As the golfer initiates the down swing by transferring weight to the left foot toward the ball impact position illustrated in FIG. 16, clockwise pivotal movement of the belt about axis 51 begins, and linkage 16 returns to an almost collapsed position about 15 degrees counter-clockwise from the address position. The column head in FIG. 16 moves toward the ball, as depicted, for example, by the arrow adjacent the column head 14 in FIG. 16. The column head moves toward and away from the ball to adjust for the posture of the golfer during the swing. In this ball impact position, the belt assembly back plate 96 is parallel to the target line and the plane 124.

Figure 17:
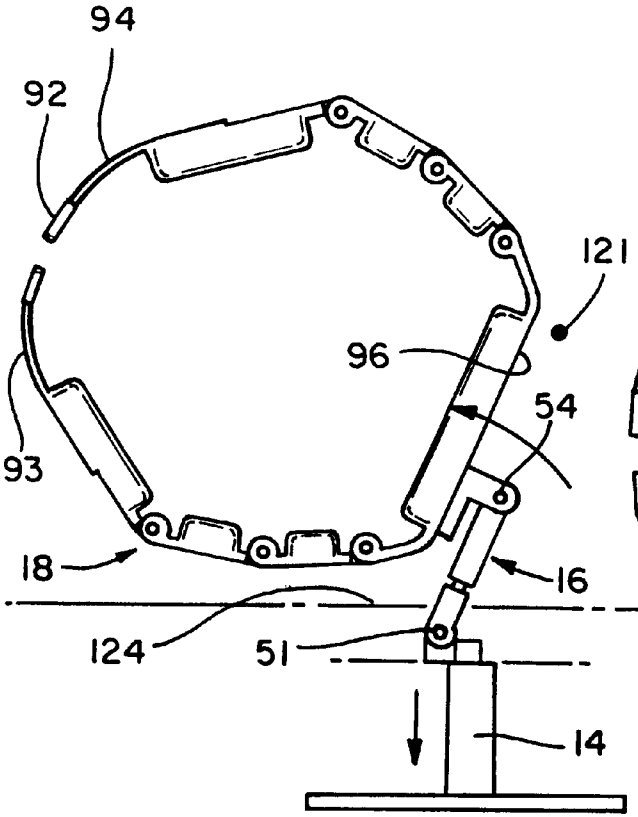

As the golfer swings through the ball at impact, the belt assembly 18 pivots about axis 51 instead of axis 121 with the link assembly 16 remaining collapsed, as depicted in FIG. 17, tending to move the belt assembly 18 toward the ball relative to the column head 14. At the same time, in this intermediate follow through position, link assembly 16 is about 90 degrees counter-clockwise with respect to plane 124, and the belt assembly back plate 96 is parallel to the link assembly 16. This movement encourages the golfer to pivot about axis 51.

The completed follow through is depicted in FIG. 18 where the link 16 is approximately 130 degrees clockwise with respect to plane 124, the linkage assembly 16 remains fully collapsed, and the belt assembly back plate 96 pivots clockwise with respect to the link assembly 16 about pivot 54 from the FIG. 17 position about 50 degrees. Note from FIGS. 17 to 18, that while the belt assembly 18 pivots about axis 51, the golfer's left side moves toward the target.

As a training aid, after completion of the follow through in FIG. 18, the golfer is encouraged to step over the left foot with the right foot toward the target, and this position is illustrated in FIG. 19 and is accommodated by the full extension of link assembly 16.

Figure 4:
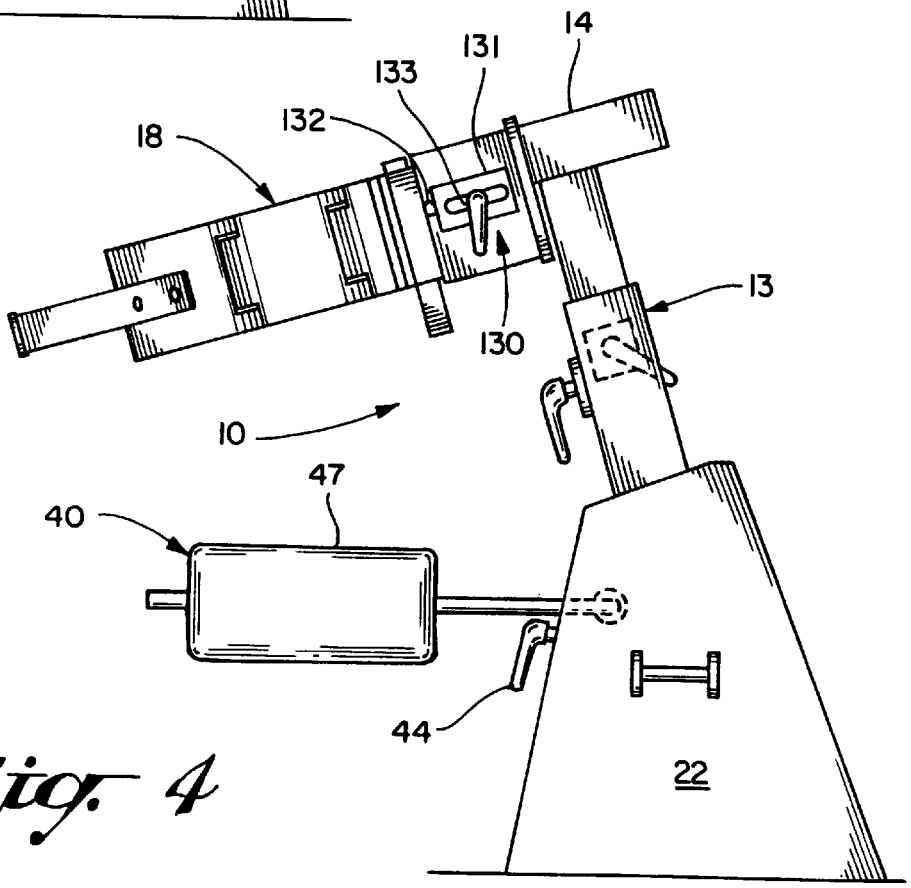
FIG. 4 is a right side view of the golf swing training system illustrated in FIGS. 1 to 3.

As seen in FIGS. 4 and 10, an adjustable stop mechanism is provided for limiting rotational movement of the link head portion 50. Adjustable stop 130 includes a slide 131 having a rubber stop member 132 at its forward end and a rotational clamp 133 extending through a slot in the slide 131. Stop member 132 engages the side of the head link portion 50, as seen in FIG. 19. The stop 132 is adjustable toward the ball in the plane of FIG. 19 and limits, if desired, rotation of link head portion 50 to less than the 180 degree position it has with respect to the reference plane 124 in FIG. 19. This limiting action may be desirable in cases where the right foot step over described with respect to FIG. 19 is not desired, or in cases where the pupil rotates his or her hips too far to the left on follow through.

We claim:

1. A golf swing training system, comprising: a base, a hip belt supported on the base adapted to encircle a substantial portion of the golfer's upper pelvic area, and means supporting the hip belt on the base including a link connected to the hip belt and pivotally connected to the base about a generally vertical pivot axis, and means for increasing the range of motion of the belt including means for extending and collapsing the link.

2. A golf swing training system as defined in claim 1, including means for pivotally connecting the link to the hip belt about a second generally vertical axis generally parallel to the first generally vertical pivot axis so the hip belt can pivot with respect to the link.

3. A golf swing training system as defined in claim 2, said hip belt having an address position facing generally perpendicular to a target line, said link being generally parallel to the target line in the address position of the hip belt, a first coil spring assembly mounted coaxial with the first pivot axis tending to rotate the link to the address position.

4. A golf swing training system as defined in claim 3, including a second coil spring assembly mounted coaxial with the second pivot axis tending to rotate the hip belt to its address position relative to the link.

5. A golf swing training system as defined in claim 4, including rotary means on each of the coil spring assemblies for adjusting the tension of the coil spring assemblies to vary the golfer's resistance to movement in both directions from the address position.

6. A golf swing training system as defined in claim 1, including a lower leg stop on the base limiting swaying back movement of the golfer's rear lower leg.

7. A golf swing training system, comprising: a base, a hip belt supported on the base adapted to encircle a substantial portion of the golfer's upper pelvic area, and means supporting the hip belt on the base including a link connected to the hip belt and pivotally connected to the base about a generally vertical pivot axis, means for increasing the range of movement of the belt including means for extending and collapsing the link, and means for pivotally connecting the link to the hip belt about a second generally vertical axis generally parallel to the first generally vertical pivot axis so the hip belt can pivot with respect to the link.

8. A golf swing training system, comprising: a base, a hip belt supported on the base adapted to encircle a substantial portion of the golfer's upper pelvic area, means supporting the hip belt on the base including a link connected to the hip belt and pivotally connected to the base about a generally vertical pivot axis, and means permitting movement of the belt in a plane perpendicular to the target line.

9. A golf swing training system as defined in claim 8, wherein the means permitting movement of the belt in a plane generally perpendicular to the target line includes a column on the base pivotally mounted about a generally horizontal axis generally parallel to the target line, said column being connected near its upper end to the generally vertical pivot axis supporting the link.

10. A golf swing training system as defined in claim 8, and means for increasing the range of motion of the belt including means for extending and collapsing the link.

11. A golf swing training system as defined in claim 10, including means for pivotally connecting the link to the hip belt about a second generally vertical axis generally parallel to the first generally vertical pivot axis so the hip belt can pivot with respect to the link.

12. A golf swing training system, comprising: a base, a hip belt supported on the base adapted to encircle a substantial portion of the golfer's upper pelvic area, and means supporting the hip belt on the base including a link connected to the hip belt and pivotally connected to the base about a generally vertical pivot axis, said hip belt having an address position facing generally perpendicular to a target line, said link being generally parallel to the target line in the address position of the hip belt, a coil spring assembly mounted coaxial with the vertical pivot axis tending to rotate the link to the address position.

13. A golf swing training system as defined in claim 12, including a second coil spring assembly mounted coaxial with a second pivot axis tending to rotate the hip belt to its address position relative to the link.

14. A golf swing training system as defined in claim 12, and means for increasing the range of motion of the belt including means for extending and collapsing the link.

15. A golf swing training system as defined in claim 12, including means for pivotally connecting the link to the hip belt about a second generally vertical axis generally parallel to the first generally vertical pivot axis so the hip belt can pivot with respect to the link.

16. A golf swing training system as defined in claim 12, including means permitting movement of the belt in a plane perpendicular to the target line.

17. A golf swing training system as defined in claim 16, wherein the means permitting movement of the belt in a plane generally perpendicular to the target line includes a column on the base pivotally mounted about a generally horizontal axis generally parallel to the target line, said column being connected near its upper end to the generally vertical pivot axis supporting the link.

18. A golf swing training system as defined in claim 12, including a second coil spring assembly mounted coaxial with a second pivot axis tending to rotate the hip belt to its address position relative to the link, said second generally vertical axis being generally parallel to the first generally vertical pivot axis so the hip belt can pivot with respect to the link, means permitting movement of the belt in a plane perpendicular to the target line, said means permitting movement of the belt in a plane generally perpendicular to the target line including a column on the base pivotally mounted about a generally horizontal axis generally parallel to the target line, said column being connected near its upper end to the generally vertical first pivot axis supporting the link.

19. A golf swing training system, comprising: a base, a hip belt supported on the base adapted to encircle a substantial portion of the golfer's upper pelvic area, and means supporting the hip belt on the base without lateral movement of the hips including a link connected to the hip belt and pivotally connected to the base about a generally vertical pivot axis, and means for increasing the range of motion of the belt including means for extending and collapsing the link.

* * * * *